US005226800A

United States Patent [19]

Morino

[11] Patent Number: 5,226,800

[45] Date of Patent: Jul. 13, 1993

[54] DISPLACEMENT CONTROLLING CIRCUIT SYSTEM FOR VARIABLE DISPLACEMENT PUMP

[75] Inventor: Kenji Morino, Kanagawa, Japan

[73] Assignee: Kabushiki Kaisha Komatsu Seisakusho, Tokyo, Japan

[21] Appl. No.: 838,255

[22] PCT Filed: Sep. 21, 1990

[86] PCT No.: PCT/JP90/01220

§ 371 Date: Mar. 10, 1992

§ 102(e) Date: Mar. 10, 1992

[87] PCT Pub. No.: WO91/04415

PCT Pub. Date: Apr. 4, 1991

[30] Foreign Application Priority Data

Sep. 22, 1989 [JP] Japan ..... 1-245320

[51] Int. Cl.[5] ..... F04B 49/00

[52] U.S. Cl. ..... 417/218; 60/452

[58] Field of Search ..... 417/218; 60/452, 431

[56] References Cited

U.S. PATENT DOCUMENTS

| | | | |
|---|---|---|---|
| 4,081,223 | 3/1978 | Fricke | 417/218 |
| 4,600,364 | 7/1986 | Nakatani et al. | 417/218 X |
| 4,637,781 | 1/1987 | Akiyama et al. | 417/218 X |
| 4,710,106 | 12/1987 | Iwata et al. | 417/218 X |
| 4,904,161 | 2/1990 | Kamide et al. | 417/218 X |
| 5,111,789 | 5/1992 | Moriya et al. | 417/218 X |

FOREIGN PATENT DOCUMENTS

| | | |
|---|---|---|
| 0232722 | 8/1987 | European Pat. Off. . |
| 57-116183 | 7/1982 | Japan . |
| 58-222989 | 12/1983 | Japan . |
| 61-190487 | 11/1986 | Japan . |
| 62-26587 | 2/1987 | Japan . |
| 837775 | 6/1960 | United Kingdom . |
| 8501326 | 3/1985 | World Int. Prop. O. . |

OTHER PUBLICATIONS

Patent Abstracts of Japan; vol. 6, No. 232, Nov. 18, 1982.

*Primary Examiner*—Richard A. Bertsch
*Assistant Examiner*—Michael I. Kocharov
*Attorney, Agent, or Firm*—Armstrong, Westerman, Hattori, McLeland & Naughton

[57] ABSTRACT

A displacement controlling circuit system for a variable displacement pump, which system permits, following high or low rates of revolution of an engine for driving the pump, the displacement of the pump to be larger or smaller than a displacement determined on the basis of a difference between the pump delivery pressure and a load pressure. The displacement controlling circuit system comprises a revolution sensor (12) for detecting rates of revolution of the engine (9), and means (10, 11) for switching a load sensing valve (5) in such a manner that: when the detected rate of revolution of the engine is high, a displacement control member (2) of the variable displacement pump (1) is actuated in a displacement increasing direction; and, when the detected rate of revolution of the engine is low, the displacement control member (2) is actuated in a displacement decreasing direction.

2 Claims, 3 Drawing Sheets

FIG.6
PRIOR ART
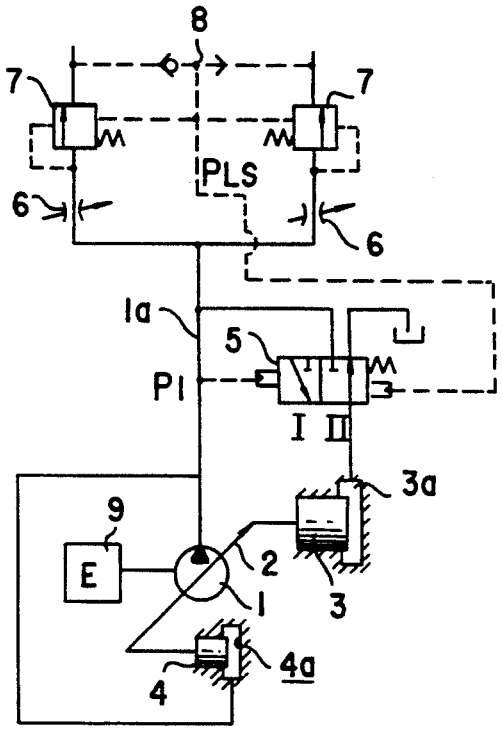
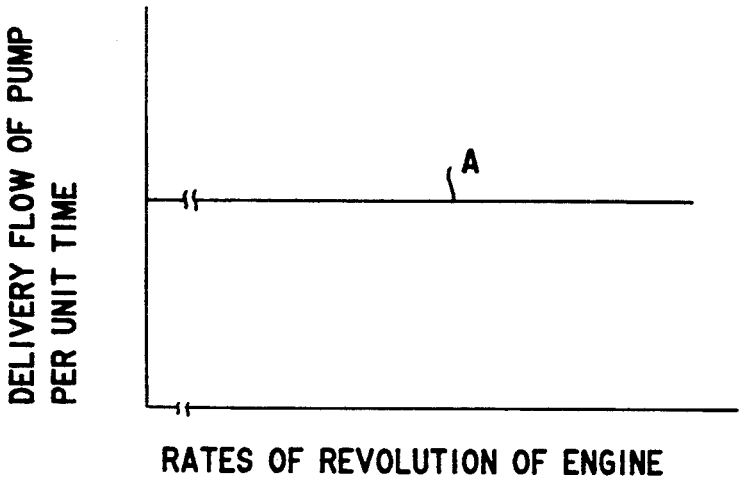
FIG.7
PRIOR ART

DISPLACEMENT CONTROLLING CIRCUIT SYSTEM FOR VARIABLE DISPLACEMENT PUMP

TECHNICAL FIELD OF THE INVENTION

The present invention relates to a circuit system for controlling a variable displacement pump.

BACKGROUND ART OF THE INVENTION

As a system for controlling a variable displacement pump in displacement, for example as shown in FIG. 6, one so controlling as to keep a difference between a delivery pressure and a load pressure constant is known.

Namely, a displacement control member 2 of a variable displacement pump 1 is actuated in a displacement reducing direction by means of a large piston 3, and actuated in a displacement increasing direction by means of a small piston 4 so that: a pressure chamber 3*a* of the large piston 3 is so controlled through a load sensing valve 5 as to be connected with a tank side and a delivery passage 1*a*; and a pressure chamber 4*a* of the small piston 4 is connected with the delivery passage 1*a*.

The above-mentioned load sensing valve 5 controls the variable displacement pump 1 in displacement in a manner such that: under the influence of a pressure or delivery pressure $P_1$ in the delivery passage 1*a* of the pump 1, the load sensing valve 5 is moved into a first position I in which the pressure chamber 3*a* of the large piston 3 communicates with the delivery passage 1*a*, and, under the influence of a pressure or load pressure $P_{LS}$ in an outlet side of an operated valve 6, the load sensing valve 5 is moved into a second position in which the pressure chamber 3*a* communicates with a tank; and, when a difference $(P_1-P_{LS})$ between the delivery pressure $P_1$ and the load pressure $P_{LS}$ increases, the pressure in the pressure chamber 3*a* of the large piston 3 is increased to actuate the displacement control member 2 in the displacement reducing direction so that a delivery flow rate/revolution is reduced to lower the delivery pressure $P_1$, and when the difference $(P_1-P_{LS})$ between the delivery pressure $P_1$ and the load pressure $P_{LS}$ decreases, the pressure in the pressure chamber 3*a* of the large piston 3 is reduced to actuate the displacement control member 2 in the displacement increasing direction so that a delivery flow rate/revolution is increased to increase the delivery pressure $P_1$, whereby the variable displacement pump 1 is controlled in displacement so as to keep always the difference $(P_1-P_{LS})$ between the delivery pressure $P_1$ and the load pressure $P_{LS}$ constant.

In FIG. 6: 7 is a pressure compensating valve; and 8 is a shuttle valve for detecting a higher load pressure which is detected by the shuttle valve 8 when a plurality of the operated valves 6 are simultaneously operated, the pressure being adapted to act on the above-mentioned load sensing valve 5 and each of the pressure compensating valves 7.

In such displacement control system: since the difference between the delivery pressure $P_1$ and the load pressure $P_{LS}$ is controlled so as to be constant, a delivery flow rate/unit time does not vary even when an engine 9 varies in rate of revolution, provided that the operated valves 6 are kept constant in opening.

For example, when the rate of revolution of the engine 9 decreases to cause the variable displacement pump 1 to be decreased in rate of revolution and in delivery flow rate/unit time, the difference between the delivery pressure $P_1$ and the load pressure $P_{LS}$ decreases so that the displacement control member 2 is actuated in the displacement increasing direction by means of the small piston 4 so as to increase the delivery flow rate/revolution and the delivery flow rate/unit time, whereby the difference between the delivery pressure $P_1$ and the load pressure $P_{LS}$ is kept constant, and, therefore the delivery flow rate/unit time does not vary even when the rate of revolution of the engine 9 varies. For example, in a condition in which the operated valves are opened to the maximums, it is kept constant as shown in FIG. 7 with A.

As a result, for example, when it is applied to a hydraulic circuit for a work unit of a construction machine, since a flow rate delivered to an actuator for the work unit is kept constant to keep the work unit constant in working speed even when the rate of revolution of the engine is changed in a condition in which the operated vales 6 are kept constant in openings, it is impossible for the work unit to perform its work with fine operations realizing a highly accurate work.

For example, even when a power shovel is used, it is impossible to perform pipe slinging operations and normal plane finishing operations too in a pipe burying work.

SUMMARY OF THE INVENTION

In view of the above circumstances, the present invention was made, an object of which is to provide a displacement control circuit system of a variable displacement pump, which system can control the pump displacement so as to have the displacement increase or decrease relative to a displacement determined on the basis of a difference between a delivery pressure of the pump and a load pressure in accordance with high rates or low rates of revolution of the engine which drives the variable displacement pump, in order to facilitate the pipe slinging operations and the normal plane finishing operations performed by the use of the power shovel.

In order to accomplish the above object, in one aspect of the present invention, there is provided: In a displacement controlling circuit system for a variable displacement pump, comprising: a variable displacement pump driven by an engine; a large-diameter piston provided with a pressure chamber to which a delivery pressure oil of the pump is supplied, the large-diameter piston actuating a displacement control member of the pump in a displacement decreasing direction when the delivery pressure oil is supplied to its pressure chamber; a small-diameter piston provided with a pressure chamber to which a delivery pressure oil of the pump is supplied, the small-diameter piston actuating the displacement control member of the pump in a displacement increasing direction under the influence of the delivery pressure oil; and a load sensing valve which is selectively switched to a first position (in which the load sensing valve permits the pressure chamber of the large-diameter piston to communicate with a delivery passage of the pump) or a second position (in which the load sensing valve permits the pressure chamber to communicate with a tank), following a differential pressure between a pressure of the delivery pressure oil and a load pressure; the improvement wherein the displacement control circuit system is further provided with: a revolution sensor for detecting rates of revolution of the engine; and means so switching the load sensing valve as to be in the second position when the thus detected rates of revolution of the engine is high and to be in the first position when the detected rates of revolution of the engine is low.

According to the present invention having the above-mentioned aspect, the load sensing valve 5 is switched to the second position II permitting communication with the tank when the engine 9 revolves at high rates, so that the displacement of the variable displacement pump 1 becomes larger than a displacement based on a difference between the delivery pressure $P_1$ and the load pressure $P_{LS}$. On the other hand, when the engine 9 revolves at low rates, the load sensing valve 5 is switched to the first position I permitting communication with the pump delivery passage 1*a*, so that the displacement of the variable displacement pump 1 becomes smaller than a displacement based on a difference between the delivery pressure $P_1$ and the load pressure $P_{LS}$.

Consequently, in case that an operated valve provided in a delivery passage of the variable displacement pump 1 keeps its opening constant, it is possible to increase a difference in delivery flow rate of the variable displacement pump between a time when the engine revolves at high rates and a time when the engine revolves at low rates, which makes it possible to decrease the delivery flow rate of the variable displacement pump by reducing the rates of revolution of the engine, so that it is possible to finely operate the work machine so as to perform the work with high accuracy, and, therefore it is possible to facilitate the pipe slinging operations and the normal plane finishing operations in the pipe burying work by the use of the power shovel.

The above object, additional objects, additional aspects and advantages of the present invention will be clarified to those skilled in the art hereinbelow with reference to the following description and accompanying drawings illustrating preferred embodiments of the present invention according to principles of the present invention.

BRIEF DESCRIPTION OF THE DRAWINGS

FIG. 6 is a hydraulic circuit diagram illustrating the conventional example; and FIG. 7 is a graph showing the relation between the rates of revolution of the engine and the delivery flow rate of the variable displacement pump driven by the engine in the conventional example shown in FIG. 6.

DETAILED DESCRIPTION OF THE PREFERRED EMBODIMENTS

Hereinbelow, an embodiment of the present invention will be described in detail with reference to the accompanying drawings.

Figure 1:
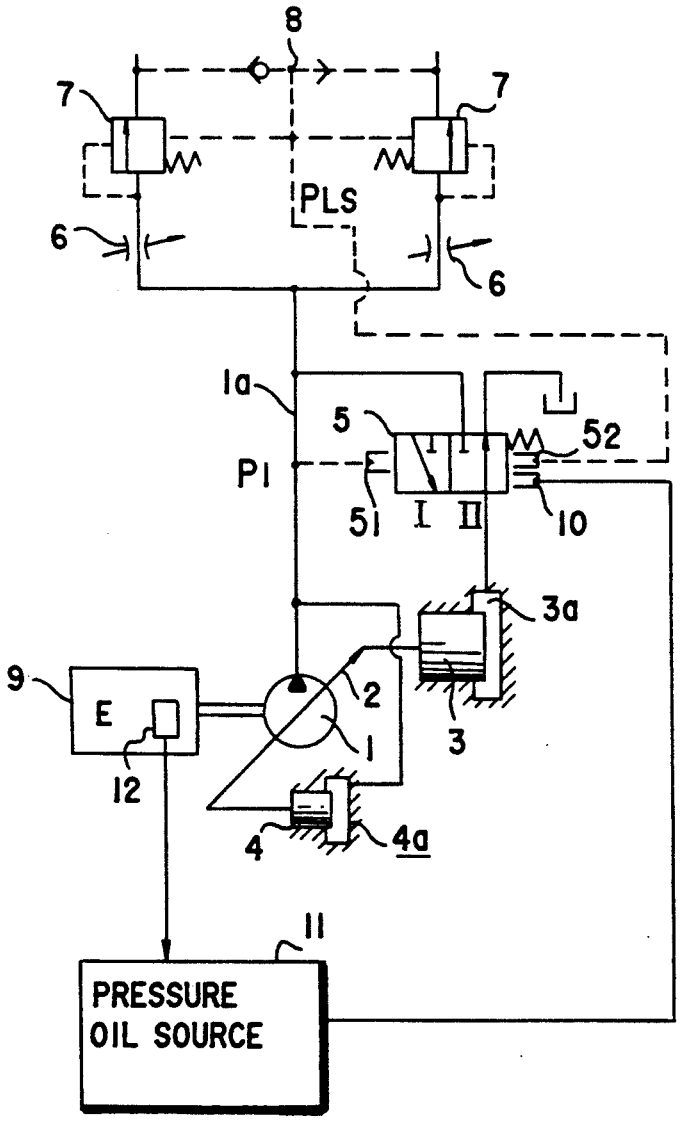
FIG. 1 is a hydraulic circuit diagram illustrating an embodiment of the present invention.

As shown in FIG. 1, a load sensing valve 5 has a first pressure receiving portion $5_1$ of its one end side subjected to a delivery pressure $P_1$ of a pump delivery passage 1*a* so as to be urged to a second position II, and has a second pressure receiving portion $5_2$ and an auxiliary pressure receiving portion 10 of the other end side thereof subjected respectively to a load pressure and an oil pressure so as to be urged to a first position I. The first pressure receiving portion $5_1$ is connected with the pump delivery passage 1*a*, and the second pressure receiving portion $5_2$ is connected with an outlet side of a shuttle valve 8. The auxiliary pressure receiving portion 10 is connected with a pressure oil source 11. Incidentally, since other parts except the auxiliary pressure receiving portion 10, pressure oil source 11 and individual accompanying components thereof are similar to those of the above-mentioned conventional system (see FIG. 6), description of such other parts will be omitted.

The pressure oil source 11 produces pressure oil in proportion to detected rates of revolution of an engine 9, which rates are detected by a revolution sensor 12 for detecting rates of revolution of the engine.

Figure 2:
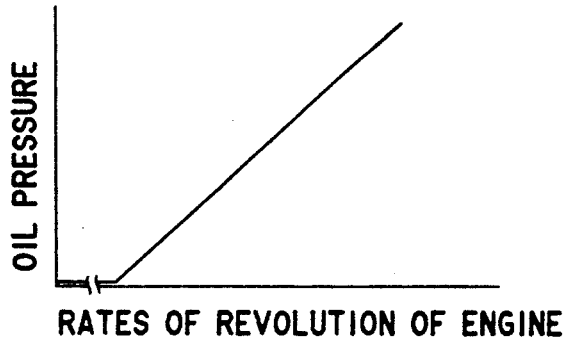
FIG. 2 is a graph showing the relation between the rates of revolution of the engine and the oil pressure of the pressure oil source driven by the engine.

For example, in order to realize performance curve shown in FIG. 2, a relief valve is provided in a delivery passage of a fixed displacement pump driven by the engine 9, a set pressure of which relief valve is set in proportion to the detected rates of revolution of the revolution sensor 12.

And, the load sensing valve 5 controls communication between the pump delivery passage 1*a* and a large-diameter piston pressure receiving chamber 3*a* so as to permit or block-off the communication, following a differential pressure between the delivery pressure $P_1$ and the load pressure $P_{LS}$the oil pressure from the pressure oil source, i.e., urging force generated in the auxiliary pressure receiving portion 10, whereby the delivery flow rate/revolution of the variable displacement pump is so controlled as to keep the difference constant.

As described above, when the engine 9 revolves at high rates, the pressure oil of the pressure oil source 11 becomes high so that the differential pressure between the delivery pressure $P_1$ and the load pressure $P_{LS}$+the oil pressure acting on the auxiliary pressure receiving portion 10 decreases, whereby the load sensing valve 5 is so moved as to have the second position II in which the communication between the pump delivery passage 1*a* and the large-diameter piston pressure receiving chamber 3*a* is blocked-off so that pressure in the large-diameter piston pressure receiving portion 3*a* decreases to move the displacement control member 2 in the displacement increasing direction, whereby the delivery flow rate/revolution increases to increase delivery flow rate/unit time.

On the other hand, when the engine 9 revolves at low rates, the pressure oil of the pressure oil source 11 becomes low pressure to decrease the auxiliary pressure receiving portion 10 thrust, so that the differential pressure between the delivery pressure $P_1$ and the load pressure $P_{LS}$+the oil pressure acting on the auxiliary pressure receiving portion 10 increases to move the load sensing valve 5 so as to have the first position I in which the communication between the pump delivery passage 1*a* and the large-diameter piston pressure receiving chamber 3*a* is permitted to increase pressure in the large-diameter piston pressure receiving chamber 3*a* so that the displacement control member 2 is actuated in the displacement decreasing direction, whereby delivery flow rate/revolution decreases to decrease delivery flow rate/unit time.

Figure 3:
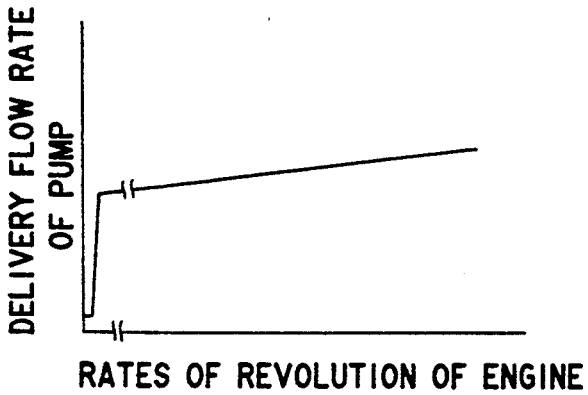
FIG. 3 is a graph showing the relation between the rates of revolution of the engine and the delivery flow rate of the variable displacement pump driven by the engine.

As described above, in switching of the first position I and the second position II of the load sensing valve 5, as is clear from the graph of FIG. 3, it goes without saying that the passage area of the pump delivery oil passing through the load sensing valve 5 is gradually increased or decreased as the load sensing valve 8 moves.

Consequently, in a condition in which the operated valve 6 keeps its opening constant, the delivery flow rate of the variable displacement pump 1 is proportional in value to the rate of revolution of the engine, so that supply flow rate in case that the operated valve 6 keeps it opening constant is proportional in value to the rate of revolution of the engine as shown in FIG. 3. Therefore, for example, in case that it is applied to a hydraulic circuit for the work machine, the work machine may have its operation speed proportional to rate of revolution of the engine.

Figure 4:
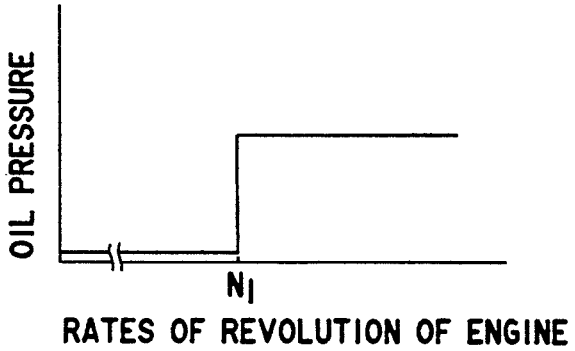
FIG. 4 is a graph showing the relation between the rates of revolution of the engine and the oil pressure of a modification of the pressure oil source driven by the engine.
Figure 5:
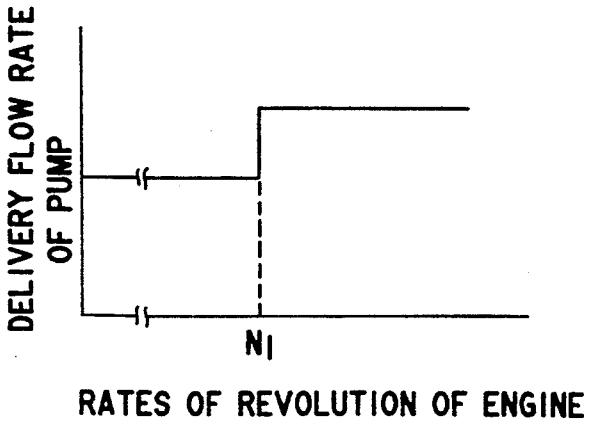
FIG. 5 is a graph showing the relation between the rates of revolution of the engine and the delivery flow rate of the variable displacement pump driven by the engine, provided that the modification shown in FIG. 4 is used.

In addition, in a modification of the above embodiment, it is possible to have the pressure oil of the pressure oil source 11 be high in pressure in a range larger than a predetermined rate of revolution $N_1$ as shown in FIG. 4. Such construction makes it possible to increase the supply flow rate (which passes through the operated valve 6) in the range larger than the predetermined rate of revolution as shown in FIG. 5.

I claim:

1. In a displacement controlling circuit system for a variable displacement pump, comprising:

a variable displacement pump driven by an engine;

a pressure oil source for feeding a delivery pressure oil in accordance with the operation of said engine;

a large-diameter piston provided with a first pressure chamber to which a delivery pressure oil of said pump is supplied, said large-diameter piston actuating a displacement control member of said pump in a displacement decreasing direction when the delivery pressure oil is supplied to said first pressure chamber;

a small-diameter piston provided with a second pressure chamber to which a delivery pressure oil of said pump is supplied, said small-diameter piston actuating said displacement control member of said pump in a displacement increasing direction under the influence of said delivery pressure oil;

a load sensing valve means operatively connected to said pressure oil source for detecting a pressure difference between said delivery oil pressure and a load pressure, said valve selectively switching to a first position in which said load sensing valve permits said first pressure chamber of said large-diameter piston to communicate with a delivery passage of said pump or a second position in which said load sensing valve permits said pressure chamber to communicate with a tank, in response to a differential pressure between a pressure of said delivery pressure oil and said load pressure;

the improvement wherein said displacement control circuit system is further provided with: a revolution sensor for detecting rates of revolution of said engine connected to said pressure oil source; and means for switching said load sensing valve means to said second position when the detected rates of revolution of said engine are above a predetermined value and to said first position when said detected rates of revolution of said engine are below said predetermined value.

2. The displacement controlling circuit system for the variable displacement pump as set forth in claim 1, wherein said load sensing valve switching means comprise: a pressure oil source driven by said engine; and a conduit which leads a delivery pressure oil from said pressure oil source to an end of said load sensing valve, on which end said load pressure acts to urge said load sensing valve to have said second position.

* * * * *